US009622642B2

(12) United States Patent
Braaten et al.

(10) Patent No.: US 9,622,642 B2
(45) Date of Patent: Apr. 18, 2017

(54) DEVICE FOR CLEANING OF FOOTWEAR

(75) Inventors: Tom Roger Braaten, Auli (NO); Morten Kaspersen, Aarnes (NO)

(73) Assignee: Alfa Omega Development AS, Aarnes (NO)

( * ) Notice: Subject to any disclaimer, the term of this patent is extended or adjusted under 35 U.S.C. 154(b) by 98 days.

(21) Appl. No.: 14/126,869

(22) PCT Filed: Jun. 15, 2012

(86) PCT No.: PCT/NO2012/050109

§ 371 (c)(1),
(2), (4) Date: Feb. 18, 2014

(87) PCT Pub. No.: WO2012/173495

PCT Pub. Date: Dec. 20, 2012

(65) Prior Publication Data

US 2014/0202504 A1 Jul. 24, 2014

(30) Foreign Application Priority Data

Jun. 17, 2011 (NO) ..... 20110873

(51) Int. Cl.
*A47L 23/00* (2006.01)
*A47L 23/02* (2006.01)
(Continued)

(52) U.S. Cl.
CPC ..... *A47L 23/02* (2013.01); *A47L 23/00* (2013.01); *A47L 23/18* (2013.01); *A47L 23/20* (2013.01);
(Continued)

(58) Field of Classification Search
CPC ..... A47L 23/00; A47L 23/02; A47L 23/18; A47L 23/20; A47L 23/22; A47L 23/24; A47L 23/26; A47L 23/205
USPC ..... 15/30, 36, 97.2, 112, 161, 237; 134/56 R, 57 R, 99.1, 115 R
See application file for complete search history.

(56) References Cited

U.S. PATENT DOCUMENTS 7,036,178 B1 * 5/2006 Sigrist ..... 15/34
2002/0189039 A1 12/2002 Schlem

FOREIGN PATENT DOCUMENTS

JP 0947422 A 2/1997
JP 2009050315 A 3/2009

OTHER PUBLICATIONS

Koichi et al., "JP0947422A English Machine Translation.pdf", Feb. 18, 1997—Machine translation from J-PlatPat.*

(Continued)

*Primary Examiner* — Michael Barr
*Assistant Examiner* — Levon J Shahinian
(74) *Attorney, Agent, or Firm* — Alix, Yale & Ristas, LLP

(57) ABSTRACT

Device for cleaning of footwear in connection with use of construction site vehicles, with a water pump (16), nozzles (20) and water pipe (18) between same. The device includes a compressor (22) for air and air pressure pipe (23) and nozzles (20, 21), an outer supporting structure in the form of a housing (2) arranged to protect the other parts of the device against external influence, The housing includes a recess (14) for receiving footwear to be cleaned. At least one sensor (25) is included for initiating cleaning when footwear is positioned in said recess (14). The device is arranged to automatically flush the footwear with water via the water pump (16) and immediately thereafter to blow the footwear dry with air from the compressor (22).

13 Claims, 2 Drawing Sheets

(51) Int. Cl.

| | |
|---|---|
| ***A47L 23/18*** | (2006.01) |
| ***A47L 23/20*** | (2006.01) |
| ***A47L 23/22*** | (2006.01) |
| ***A47L 23/24*** | (2006.01) |
| ***A47L 23/26*** | (2006.01) |

(52) U.S. Cl.
CPC ..... *A47L 23/205* (2013.01); *A47L 23/22* (2013.01); *A47L 23/24* (2013.01); *A47L 23/26* (2013.01)

(56) References Cited

OTHER PUBLICATIONS

International Search Report and Written Opinion dated Sep. 24, 2012 (PCT/NO2012/050109).

* cited by examiner

DEVICE FOR CLEANING OF FOOTWEAR

BACKGROUND

The present invention concerns a device for cleaning footwear in connection with use of construction site vehicles.

Modern construction site vehicles, tractors and trucks are arranged for high comfort, having good seats, good suspension, air conditioning etc. to make the workplace as comfortable and aesthetically attractive as possible. A comfortable work environment is also an aspect of safety, since it makes it easier to maintain concentration on the tasks to be performed.

Such vehicles, hereinafter generally referred to as construction site vehicles, are typically used in environments which are dirty, dusty, muddy and sometimes moist. Frequently therefore soil, dirt and mud will follow the user's footwear into the driver's cabin constituting their workplace. There is therefore a number of examples of workplaces which could be clean and attractive, which commonly are so dirty and dusty that they can be harmful for the user and possibly constitute a risk for the driver/user to lose concentration. There is a variety of equipment designed for cleaning footwear but none that is well suited for quickly ant automatically cleaning the user's footwear each time the user enters the vehicle.

Japanese patent publication No. 2000 023897 describes equipment for cleaning of boots by means of water and a rotating brush.

From WO 05 089622 similar equipment is known that is very comprehensive and voluminous.

U.S. Pat. No. 6,668,842 describes more compact equipment for disinfecting footwear by means of water and disinfectant.

SUMMARY

It is thus an object of the disclosure to provide equipment for cleaning of footwear for use primarily in construction site vehicles which quickly and effectively cleans and dries the footwear. The device is quick and effective that it may easily be used every time a person enters the vehicle without being perceived as delaying or interfering.

The device is also easy to place in relation to existing entering arrangements and has a very compact design.

By construction site vehicles is contemplated especially, but not only, tractors, excavators, dumper-trucks, wheeled loaders, and bulldozers.

The disclosed device provides a solution to a long acknowledged problem related to dirt that is brought in with the footwear. It might be seen as an easy task to clean footwear but obviously it is not since the problem has not been solved. There are many considerations to be made. On one hand the equipment must be robust enough to endure the environment in which the vehicles at any time are used in. Secondly it should be compact as not to steal important space needed for other purposes. It should be positionable such that it is not perceived as a detour when using it and it should be so quick that the user does not feel he is wasting valuable time by always cleaning the footwear when entering the vehicle. It should also be so easy to use—in practice automatic—that no training is required. At the same time it needs to be safe and not erroneously start if e.g. a hand is entered instead of a boot or the like. The localization of the device is typically such that the user walks just by—or "through"—the device. It is convenient where ladder rungs are arranged for entering the vehicle cabin that the device is arranged in connection with a ladder rung. With its compact design it may be integrated in a ladder rung that the user anyhow will make use of and therefore not sees as a detour to step into for making use of the device. The device comprises both cleaning and drying of the footwear, since both are of significance in order to maintain a clean and nice work environment.

Sensor controlling and automatics ensure that the equipment according to disclosure is used consistently and sufficiently and yet not exaggerated, independent of the user and the user's habits. Sensor controlling also provides a significant degree of safety, such as detecting and only activating a cleaning cycle when a "grown" person's foot is placed in the recess constituting the cleaning area.

BRIEF DESCRIPTION OF THE DRAWINGS

Below a further description of the invention is provided in the form of an exemplary embodiment illustrated in the enclosed drawings.

DETAILED DESCRIPTION

Figure 1:
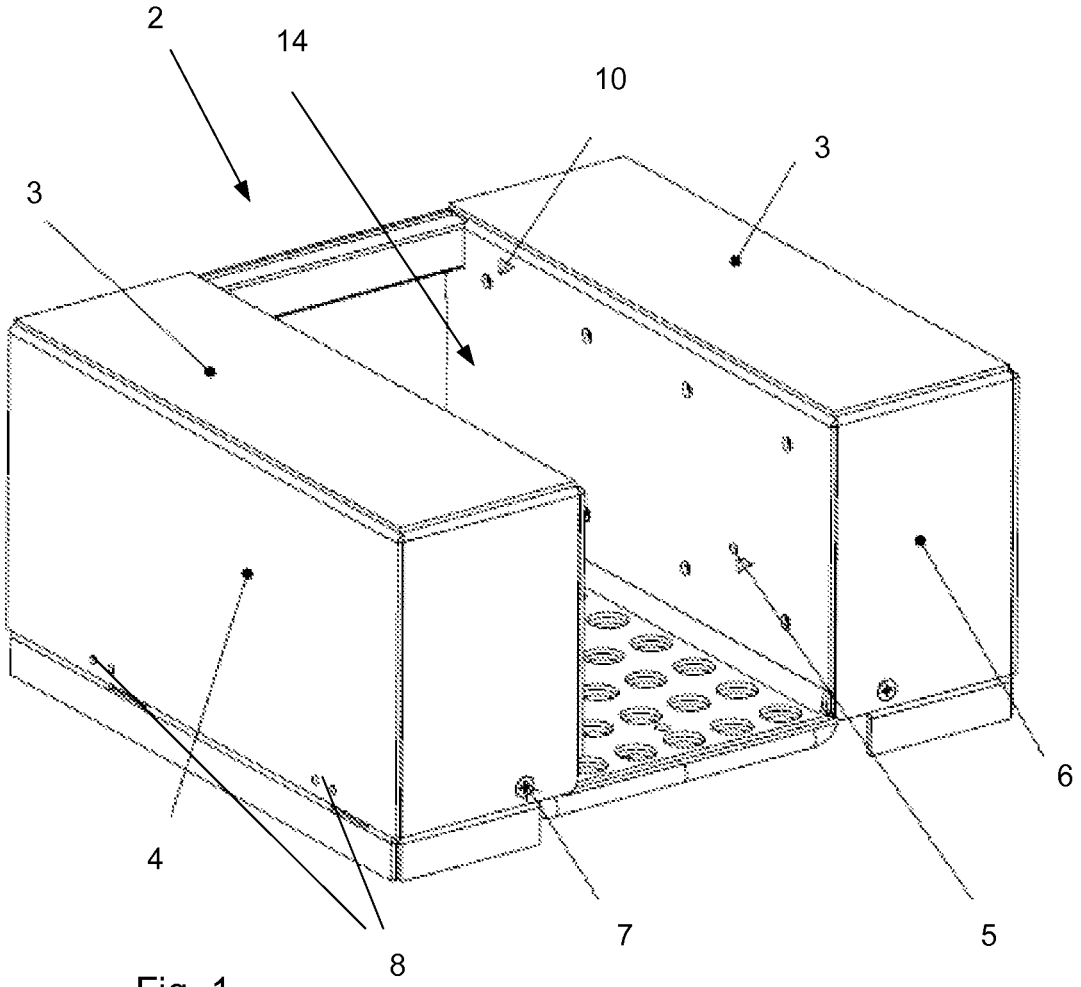
FIG. 1 shows an exemplary embodiment of the disclosed cleaning device.

With reference to FIG. 1, outer parts have the form of a housing 2 comprising cover plates hiding and protecting the inner elements of the device. There are typically top covers 3, side covers 4, front covers 6 in two blocks surrounding a recess 14. The covers can largely be joined by screws or welded together and attached to the device as such by means of screws 7 and or hinges 8 which when needed provides easy access to the inner parts of the device. The outer parts have the combined functions of protecting the inner, operative elements against damage. In some embodiments the top covers function as rung of a ladder or as part of a floor or cover on which the user can walk. Additionally holes 5 are shown in inner side cover towards the recess 14.

Figure 2:
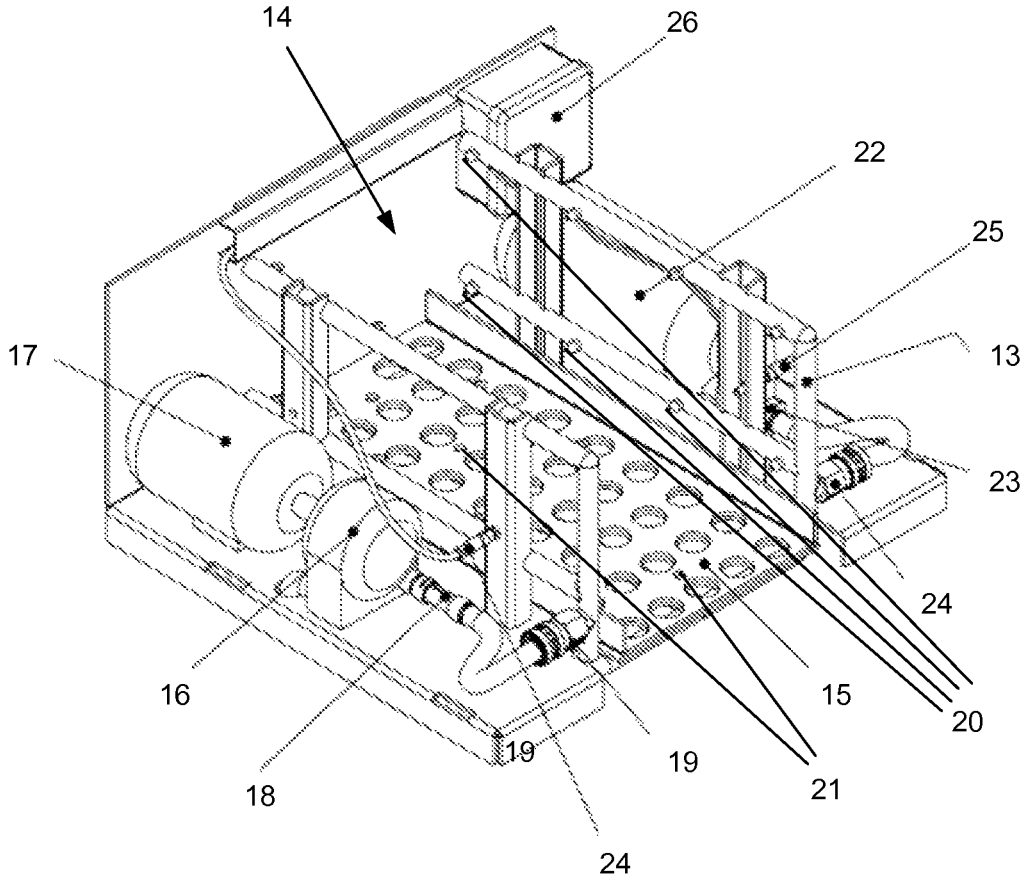
FIG. 2 shows the device of FIG. 1 with portions of the outer housing removed to show the operative, inner elements.

Hereinafter the inner, operative elements will be described with reference to FIG. 2. Water supplied from an external tank (not shown) is pumped with a water pump 16 powered by a motor 17 in a water pipe 18 to a rapid coupling 19 into a distribution tube 13. The distribution tube's left part is connected to the distribution tube's right part below a foot plate 15. At the left side as well as at the right side of the distribution tube 13 nozzles 20 are provided, four nozzles at each side in two pipes of the distribution tube 13 arranged vertically one over the other. The nozzles are oriented substantially towards the recess 14 into which a boot can be placed for cleaning. Marking lines are drawn to five nozzles on the right side of the recess 14 but it should be understood that in this preferred embodiment there are a total of eight nozzles on the right side and eight nozzles on the left side. There are also nozzles 21 arranged, preferably at least two and more preferably at least three on a row, under the foot plate 15, with an upwards direction towards the area in which a shoe sole will be positioned during cleaning, through holes in the foot plate 15.

To the right side of the recess 14 an air compressor 22 is shown as well as air pressure pipes 23 leading to a rapid coupling 24, for supplying air to the distribution tube 13. When the device shown is connected to equipment which already comprises a compressor, an air pressure pipe from such an external compressor may serve as the source of pressurized air, rendering superfluous a separate compressor integrated in the device.

The distribution tube 13 provides a common piping for air and water to the nozzles 20 and to provide a rigid structure for the nozzles so that they are maintained in a fixed, stable position during use.

Air may thus be supplied through the same piping defined by the distribution tube 13 as the water, which contributes to a simple, compact, and robust overall design.

Sensors 25 are arranged at both sides of the recess 14 to detect when a piece of footwear is positioned within the recess and thereby, via electric signals, activating a cleaning cycle. Varying degrees of safety measures may be included by the manner with which the sensors are arranged, the number of sensors and possible interaction between sensors. When using two sensors, as a minimum there can be a requirement of proximity to at least one sensor on each side for the cleaning cycle to be activated. Thereby erroneous activation is avoided, if for example a hand comes close to one sensor, since the hand will be too small to be near the other sensor on the opposite side. By using two pairs of sensors the degree of safety can be increased by requiring corresponding proximity at four different points rather than two. The sensors can then register both length and width of the footwear or "object" inserted. The footwear must then have a certain minimum width and also a certain minimum length for cleaning to be initiated. In this way it is prevented that e.g. a child's shoe can trigger the cleaning cycle. Additional sensors may be used for detecting—and requiring—a certain profile of the footwear for activating the cleaning cycle. The cycle length can also be increased by introducing a certain delay, but this comes at the cost of increased time.

The sensors are connected to a controlling unit 26 which receives and processes information from the sensors and controls the cleaning process by signals to the motor for water pump and compressor for pressurized air in accordance therewith. While the depicted device includes numerous nozzles, the depicted number and configuration is non-limiting. For example, another embodiment includes only one nozzle 20 with mainly horizontal working direction at each side of the recess 14 and one nozzle 21 under the recess 14 with a mainly vertical working direction. Nozzles can also be arranged at sites and with orientations not illustrated in the drawings, e.g. a nozzle arranged to flush with an inclination down onto the forefoot part of footwear placed in the recess. The nozzles may be of different types and a particularly suitable type is the so-called turbo-nozzle or rotating nozzle.

A person skilled in the art will acknowledge that the present invention can be arranged anywhere there is sufficient space, but a convenient arrangement localization is a place where the user will typically pass regularly, when entering the vehicle. It is presupposed that connection to electric power and water is possible. Electric power will always be available in such vehicle and only require pulling a cable from a fuse to the device. If there is not a tank for water on the vehicle in question, a separate tank may be mounted elsewhere. The particular type of water source is, however, not critical to the disclosed device. In most cases a water tank is present and a pipe is positioned to lead water to the water pump 16. The device may be deactivated completely e.g. when parking the vehicle for a longer period of time. Preferably, the device is configured for remote activation, e.g. by means of a key or coded switch on the device. The present invention allows a quick and simple cleaning of footwear when entering a construction site vehicle in a manner which may be built into new vehicles, but which also allows subsequent installation into already existing vehicles. A robust and compact design having safety measures and automatic start and stop and drying as well as cleaning, allows the driver's environment to be maintained as neat and tidy as desired, which is seldom the case at present.

The invention claimed is:

1. A device for cleaning of footwear in connection with use of construction site vehicles, comprising a water pump (16) fluidly connected to a plurality of nozzles (20, 21) via a water pipe (18);

an air pipe (23) fluidly connected to a source of pressurized air and the plurality of nozzles (20, 21);

a housing (2) arranged to protect the other parts of the device against external influence, having a recess (14) for receiving footwear to be cleaned; and at least one sensor (25) for initiating a cleaning cycle when footwear is positioned in said recess (14), the cleaning cycle including a period automatically-initiated flushing water from the water pump (16) through the plurality of nozzles (20, 21) into the recess (14), thereby contacting the footwear with water followed by immediate blowing of air from the source of pressurized air through the plurality of nozzles (20, 21) into the recess (14), thereby drying the footwear, while the footwear remains stationary in the recess (14) throughout the cleaning cycle, wherein the recess (14) for receiving footwear to be cleaned is partially defined by a lower footplate (15) having a surface through which water and dirt can pass, and at least one inwardly pointed lower nozzle (21) is positioned beneath the lower footplate (15) and configured for flushing and subsequently drying the footwear in the direction from the lower footplate (15).

2. The device of claim 1, wherein the source of pressurized air is chosen from the group consisting of an external compressor and a compressor integrated into the device.

3. The device of claim 1, wherein the recess is laterally defined by a pair of spaced sides and at least one nozzle (20) is positioned at each lateral side.

4. The device as claimed in claim 1, wherein the recess is laterally defined by a pair of spaced sides and a plurality of inwardly pointed nozzles (20) are mounted in at least one row along each side of the recess (14).

5. The device of claim 4, wherein two rows of nozzles (20) are arranged at each side of the recess (24).

6. The device of claim 1, wherein the recess is defined by a lower surface between a pair of laterally spaced sides.

7. The device of claim 6, comprising a plurality of lower nozzles (21) arranged in at least one row.

8. The device of claim 1, wherein at least one of the plurality of nozzles (20, 21) is a rotating nozzle.

9. The device of claim 1, wherein the air pipe (23) and the water pipe (18) are connected to a rigid distribution tube (13) surrounding the recess (14).

10. The device of claim 1, comprising at least two spaced sensors (25) configured for initiating the cleaning cycle via an activation signal, the at least two sensors (25) spaced apart a predetermined distance and the activation signal requiring at least two of the at least two sensors to provide a signal before initiating the cleaning cycle.

11. The device of claim 1, wherein at least two sensors (25) are arranged at each side of the recess (14) for activating the cleaning cycle via an activation signal, the activation signal requiring at least two of the at least two sensors to provide a signal before initiating the cleaning cycle.

12. The device of claim 1, being configured for mounting on a rung of a ladder on a vehicle or as an integral part of a ladder on a vehicle.

13. The device of claim 1, comprising a controlling unit (26) operatively connected to the at least one sensor (25), water pump (16) and a compressor (22), the controlling unit (26) configured for controlling starting and stopping the cleaning cycle.

* * * * *